United States Patent [19]

Poulain

[11] 4,124,957

[45] Nov. 14, 1978

[54] STRUCTURAL IMPROVEMENTS FOR STAIRS OR STAIRS WITH VARIABLE GEOMETRY

[76] Inventor: Robert A. Poulain, 588, Chaussée Bara, Waterloo, Belgium

[21] Appl. No.: 822,785

[22] Filed: Aug. 8, 1977

Related U.S. Application Data

[63] Continuation-in-part of Ser. No. 792,733, May 2, 1977, abandoned.

[30] Foreign Application Priority Data

May 3, 1976 [BE] Belgium ..... 166672

[51] Int. Cl.[2] ..... E04F 11/06

[52] U.S. Cl. ..... 52/183

[58] Field of Search ..... 52/183, 189; 182/1, 182/2, 96

[56] References Cited

U.S. PATENT DOCUMENTS

| | | | |
|---|---|---|---|
| 624,782 | 5/1899 | Fuchs | 52/183 X |
| 2,245,825 | 6/1941 | Ross | 52/183 X |
| 3,885,365 | 5/1975 | Cox | 52/183 |
| 3,962,838 | 6/1976 | Cox | 52/183 |

*Primary Examiner*—J. Karl Bell

[57] ABSTRACT

The present invention relates to staircase structures and in particular provides a staircase structure in which the components may be substantially prefabricated and erected on site. Standardized components are generally used whereby labor is minimized while the staircase is adjustable for various slopes. The structure basically comprises a pair of stringers, each formed of upper and lower shafts which are movable longitudinally with respect to each other and can be spaced apart. Tread supporting members extend between the upper shafts and lower shafts for receiving the tread members.

4 Claims, 6 Drawing Figures

STRUCTURAL IMPROVEMENTS FOR STAIRS OR STAIRS WITH VARIABLE GEOMETRY

This application is a continuation-in-part of U.S. application Ser. No. 792,733, filed May 2, 1977, now abandoned.

The present invention relates to staircases and more particularly, relates to a variable staircase structure.

Staircases suitable for use in various residential and commercial structures have traditionally been formed on site although the use of prefabricated staircase structures is known. Usually prefabricated staircases, where available, have a fixed height and slope and consequently, are only suitable for use in so-called standard applications. Even in such standard applications, problems are frequently encountered since the height and horizontal distance available for the staircase often does not correspond to the actual dimensions available following construction. This causes considerable problems since adjustments must be made and if the adjustment required is too great, this can not be done as often the space is not available and furthermore, will result in staircases wherein the rise and/or tread width is not uniform in contravention of the building codes.

For the above reasons, as aforementioned, many staircases have been manufactured/formed on site. Although the erection of a staircase does not present problems to a skilled tradesman, the construction of the same is still a labour-intensive one.

Accordingly, it is an object of the present invention to provide a staircase structure which can be substantially prefabricated and which is of an adjustable and variable structure to fit many different applications.

According to one aspect of the present invention, in a staircase having a plurality of treads extending between a pair of parallel stringers, there is provided the improvement wherein each of said stringers comprises a pair of parallel shafts and a plurality of tread supporting members extending between the shafts forming said stringers, said tread supporting members being rotatably journalled in said shafts.

In a further aspect of the present invention, there is provided a staircase structure comprising a pair of stringers, each of said stringers comprising an upper shaft and a lower shaft, each of said upper shafts and lower shafts having means for receiving tread supporting members, and a plurality of treads, means on said treads for receiving tread supporting members, the distance between said means on said tread supporting members being equal to a distance between said means on said shafts when said shafts are proximate each other.

In greater detail, as is conventional, the staircase of the present invention employs a pair of parallel stringers. Each of the stringers comprises a pair of shafts — an upper shaft and a lower shaft. In this respect, it will be understood that the terms "upper" and "lower" as employed herein are used in the context of the spatial relationship of the structure with the supporting surface on which the staircase and stringers rest. The upper and lower shaft forming each stringer are movable relative to each other, both in a longitudinal direction and in a transverse direction. The upper and lower shafts may be joined together to form a rigid structure as will be discussed in greater detail hereinafter.

The present invention also employs tread supporting members. For each step or tread, there are at least two tread supporting members extending between the stringers with a first one of the tread supporting members extending from the upper shaft of a first stringer to the upper shaft of the second stringer. Similarly, a second tread supporting member extends between the lower shaft of a first stringer and the lower shaft of the second stringer. The tread supporting members are preferably rotatably journalled with respect to the shafts for reasons which will become apparent hereinafter.

The treads or steps are basically of a substantially conventional design — they may include means for receiving the tread supporting members. Thus, in one embodiment, the tread supporting members may comprise shafts rotatably journalled in the stringers with one or more grooves being formed in the underside of the tread to receive said supporting member shafts.

The present invention also includes means for securing the tread supporting members to the shafts forming the stringers in a secure manner. Thus, treads may be formed on one end of the tread supporting members adapted to engage with a threaded locking member.

The present invention, in forming a variable staircase structure, does so on the basis of the shafts forming the stringers being in the form of a parallelogram, the shafts being movable both in a longitudinal and in a transverse manner with respect to each other. By so doing, the structure may be adjusted to fit many different applications requiring staircases.

Conventional materials may be employed in forming the components of the present invention and in this respect, wood is frequently used especially for residential applications.

Having thus generally described the invention, reference will be made to the accompanying drawings illustrating embodiments thereof, in which.

Figure 1:
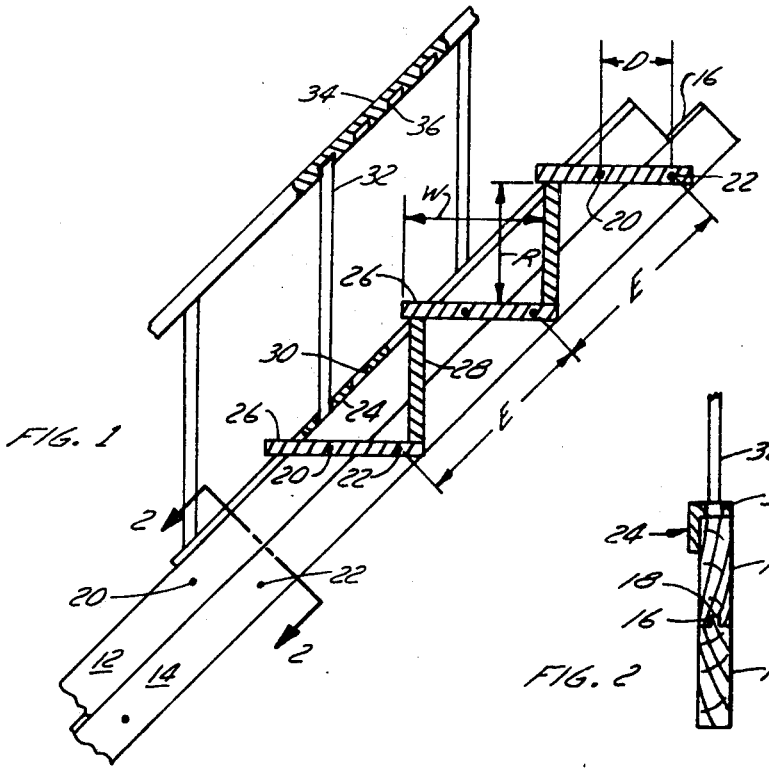
FIG. 1 is a side elevational view of a staircase structure according to the present invention.
Figure 2:
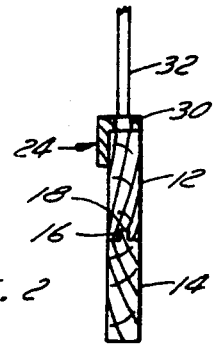
FIG. 2 is a cross-sectional line along the lines 2—2 of FIG. 1.

Referring to the drawings in greater detail, FIG. 1 illustrates a staircase structure formed of a pair of parallel stringers (only one shown). Each stringer is comprised of a pair of parallel longitudinally extending shafts 12 and 14. Lower shaft 14 has a tongue 16 on an upper side thereof while upper shaft 12 has a mating groove 18 such that shafts 12 and 14 are slidable with respect to each other. In addition, each of shafts 12 and 14 have a plurality of apertures 20 and 22 respectively extending therethrough. A railing support 24 extends along the upper side of shaft 12.

In operation, shafts 12 and 14 are moved longitudinally with respect to each other until apertures 20 and 22 are aligned so as to be parallel with the horizontal plane. A first step or tread supporting member may then be inserted through aperture 20 to a like aperture in the upper shaft of the second stringer. Similarly, a tread supporting member is inserted through aperture 22 to a corresponding aperture in the lower shaft of the other stringer. Steps or treads 26 are then braced between the stringers and supported on the members extending therebetween. In this respect, treads 26 may conveniently have a groove cut in the underside thereof such that they will seat on the supporting members.

In the illustrated embodiment, the distance D between apertures 20 and 22 when aligned in a horizontal plane is always constant. The treads have a width of W and a rise of R with distance E always being constant.

Railway support member 24 may conveniently have a plurality of slots 30 therein to receive posts 32 supporting railing 34. In this respect, railing 34 may have similar slots 36 therein for reasons to be discussed hereinafter.

Figure 3:
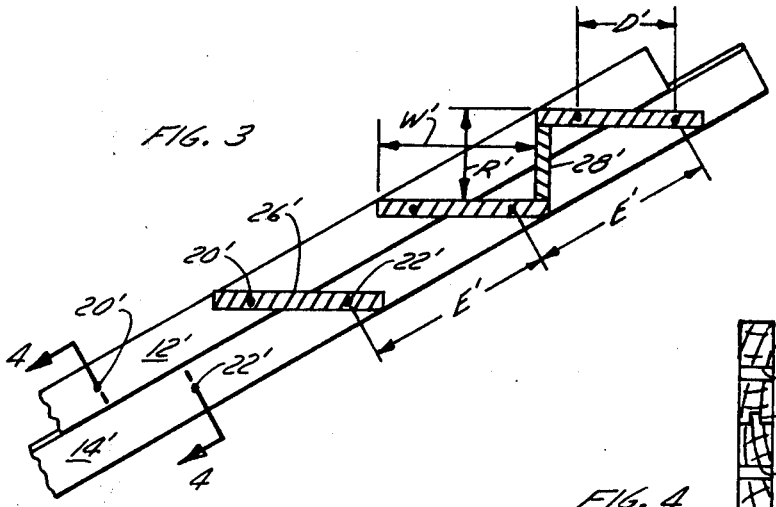
FIG. 3 is a side elevational view of a staircase structure similar to FIG. 1 illustrating a different slope.
Figure 4:
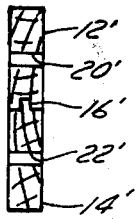
FIG. 4 is a sectional view along the lines 4—4 of FIG. 3.

Turning to FIG. 3, the staircase structure therein has a slope substantially less than that of FIG. 1. The structure includes a pair of shafts 12' and 14' having apertures 20' and 22' therein. In this embodiment, treads 26' have a width W' greater than the width W of the embodiment of FIG. 1 and have a corresponding rise R' less than that of the rise R of FIG. 1. Distance E' is, however, the same as distance E in FIG. 1.

In adjusting the staircase from the embodiment illustrated in FIG. 1 to that of FIG. 3, treads having a different width W' may be employed; these treads would also have a greater distance D' between the means adapted to receive the supporting members. Thus, the same shafts 12 and 14 may be employed with different treads 26' and risers 28'. In constructing the staircase on site, there may be available a plurality of different treads and risers having certain predetermined dimensions such that a number of different slopes may be employed. In this respect, referring back to FIG. 1, the railing may also be adjustable. In other words, slots 30 in supporting member 24 may be dimensioned such as to allow the railing to assume the same slope as that of the staircase following which members 32 are fixedly secured. Alternatively, slots 30 and 36 may be formed to have different angles for receiving members 32 whereby, depending on the slope of the staircase, only every fourth or fifth slot is employed.

Figure 5:
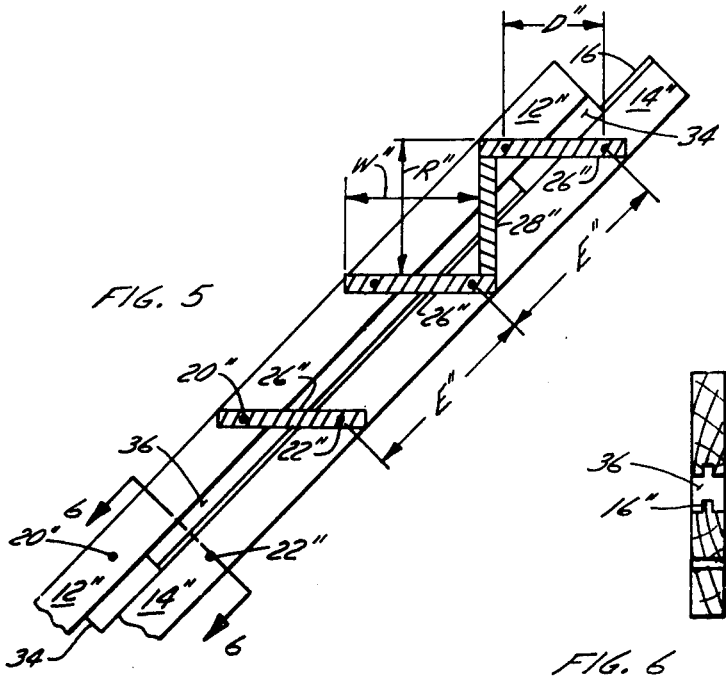
FIG. 5 is a side elevational view of the staircase structure of FIG. 3 illustrating how the structure can be adjusted for different slopes.
Figure 6:
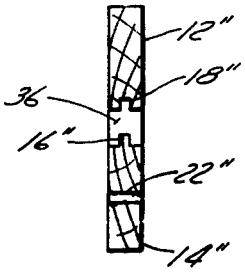
FIG. 6 is a sectional view through the lines 6—6 of FIG. 5.

Turning to the embodiment of FiG. 5, there is illustrated a staircase structure having a slope substantially equal to that of FIG. 1, but employing the same members as FIG. 3. Thus, the staircase structure includes a stringer formed of an upper shaft 12'' and a lower shaft 14''; shaft 14'' has a tongue arrangement 16'' on an upper side thereof while upper shaft 12'' has a groove 18'' on the lower side thereof. Upper shaft 12'' has apertures 20'' and lower shaft 14'' has apertures 22''. Treads 26'' have a groove in the underside thereof to receive a supporting member extending between the apertures in the upper and lower shafts.

In this embodiment, it will be noted that distance D'' — i.e. the distance between the supporting members — corresponds to distance D' in FIG. 3. Similarly, the treads 26'' have a width W'' corresponding to treads 26' of FIG. 3. Thus, the same shafts and treads may be employed even although the slope is different. To achieve the same, one or more spacer blocks 34 may be employed to separate shafts 12'' and 14'' to maintain the distance D'' equal to that of D'. Conveniently, blocks 34 may have a tongue and groove arrangement (not shown) to mate with tongue 16'' of shaft 14'' and groove 18'' of upper shaft 12''. One or more of blocks 34 may be employed to achieve the desired spacing leaving a space 36 between shafts 12'' and 14''. The number of blocks will depend on the load to be supported, the material and dimensions of the shafts, etc. Suitable means may be used for securing blocks 34 in place.

Thus, it will be seen that varying slopes may be achieved using pre-cut standard pieces for the staircase structure. In this embodiment, the only component which would be non-standard would consist of spacer blocks 34. Naturally, a plurality of spacer blocks 34 having different dimensions could be available to permit the same treads 26'' and shafts 12'' and 14'' to be employed irrespective of the slope and dimensioning of the staircase. Risers 28'' may also be standard equipment and may be secured to the staircase such that they extend downwardly below each tread — i.e. they again would be of a standard dimension. In other words, the treads may have a nose extending beyond the riser as is presently commonly done.

In lieu of the spacer blocks 34, other adjustable means may be employed to separate the upper and lower shafts as desired. Thus, suitable hinging and/or spacing means to keep shafts 12 and 14 parallel and permit longitudinal movement with respect to each other may be used.

It will be understood that the above-described embodiments are for purposes of illustration only and that changes and modifications may be made thereto without departing from the spirit and scope of the invention. Thus, for example, as aforementioned, a railing structure may easily be incorporated in the staircase as illustrated in FIGS. 3 and 5. The tread supporting member may conveniently be rotatably journalled in shafts 12 and 14 and means may be supplied for fixedly securing the supporting members thereto. Thus, the supporting members may be externally threaded at the ends thereof and suitable locking means (nuts, etc.) employed to lock the supporting members in the desired position.

It will also be understood that, for example, a single stringer may be employed for a staircase. In this instance, the single stringer would again comprise a pair of shafts, with the stringer being located more or less centrally of the treads.

I claim:

1. A staircase comprising a pair of parallel stringers having a plurality of steps extending therebetween, each of said stringers comprising an upper and a lower shaft, said shafts being parallel to each other, and being longitudinally movable with respect to each other, said shafts having a mating tongue and groove arrangement for movement relative to each other, each of said shafts having a plurality of apertures therein, a plurality of step supporting members extending between respective top shafts and respective bottom shafts through said apertures therein, each of the steps being supported by at least a first step supporting member extending between said top shafts and a second step supporting member extending between said bottom shafts, means for locking said step supporting members within said apertures, and means associated with said top shaft for receiving railing members.

2. The staircase of claim 1 wherein said stringers are formed of a wood material.

3. The staircase of claim 1 wherein said top shafts have a plurality of slots therein for receiving members adapted to form a hand rail.

4. The staircase of claim 3 wherein said means for supporting said steps comprises threaded metallic rods having nuts associated therewith for retaining said rods in the desired position.

* * * * *